United States Patent [19]

Kumar et al.

[11] Patent Number: 4,464,205

[45] Date of Patent: Aug. 7, 1984

[54] WROUGHT P/M PROCESSING FOR MASTER ALLOY POWDER

[75] Inventors: Prabhat Kumar; Ronald D. Rivers, both of Kokomo, Ind.; Anthony J. Hickl, Wyomissing, Pa.

[73] Assignee: Cabot Corporation, Kokomo, Ind.

[21] Appl. No.: 555,314

[22] Filed: Nov. 25, 1983

[51] Int. Cl.[3] ..... B22F 1/00; B22F 3/16

[52] U.S. Cl. ..... 148/11.5 P; 419/28; 419/30; 419/33; 75/246

[58] Field of Search ..... 148/11.5 P; 75/246; 419/28, 30, 33

[56] References Cited

U.S. PATENT DOCUMENTS

| | | | |
|---|---|---|---|
| 2,329,698 | 9/1943 | Dean | 75/22 |
| 2,746,741 | 1/1954 | Naeser | 266/5 |
| 3,052,976 | 9/1962 | Renback | 29/420 |
| 3,122,434 | 9/1960 | Reed et al. | 75/214 |
| 3,270,409 | 9/1966 | Grant | 29/420.5 |
| 3,436,802 | 4/1969 | Cohen | 29/420.5 |
| 3,462,260 | 8/1969 | Thafvelin et al. | 419/30 |
| 3,498,782 | 3/1970 | Spink et al. | 419/30 |
| 3,744,993 | 7/1973 | Matt | 75/213 |
| 3,775,101 | 11/1973 | Freche | 75/213 |
| 3,810,757 | 5/1974 | Andrews | 29/420.5 |
| 3,827,921 | 8/1974 | Sherby et al. | 148/11.5 P |
| 3,834,004 | 9/1974 | Ayres | 29/420.5 |
| 3,975,193 | 8/1976 | Nayar | 75/211 |
| 3,976,482 | 8/1976 | Larson | 419/30 |
| 4,045,857 | 9/1977 | Suzuki | 29/420 |
| 4,069,044 | 1/1978 | Mocarski | 75/243 |
| 4,110,131 | 8/1978 | Gessinger | 148/11.5 N |
| 4,343,650 | 8/1982 | Rivers | 75/213 |

*Primary Examiner*—W. Stallard

*Attorney, Agent, or Firm*—Jack Schuman; Joseph J. Phillips; Robert F. Dropkin

[57] ABSTRACT

A powder metallurgical process for producing a wrought product characterized by a low level of residual impurities. The process comprises the steps of: comminuting metal powder to effect a reduction in particle size, at least 60% of the comminuted particles being capable of passing through a −270 mesh Tyler screen; blending the metal powder with a softer metal-bearing powder; heating the blended powder particles at an elevated temperature, the particles adhering and forming a mass during heating; crushing the mass of powder particles; cold-isostatically pressing the crushed mass of powder; sintering the powder in the absence of an encapsulating member under conditions which effect a reduction in the nitrogen, oxygen and carbon levels of the powder; and hot working the sintered powder into a wrought product. The wrought product has less than 0.015% carbon.

12 Claims, No Drawings

WROUGHT P/M PROCESSING FOR MASTER ALLOY POWDER

The present invention relates to a process for producing a wrought product from metal powder and, more particularly, to a process for producing a wrought product characterized by a low level of residual impurities.

Metallurgists have developed a number of processes for casting metal of low carbon content and for making metal powder of low carbon content. They have not, however, succeeded in developing a truly satisfactory process for producing wrought products of low carbon content from metal powder. This is true despite the use of vacuum melting and inert gas atomization which yields powder having very low carbon levels, e.g., 0.002%. Carbon is picked up by the powder during processing.

The need for a low carbon wrought powder metallurgical product is nevertheless very strong. Carbon has a deleterious affect on the properties of many alloys. It is, for example, known to degrade the corrosion resistance of nickel-base alloys.

Through the present invention there is provided a process for producing a low-carbon wrought powder metallurgical product. Alloy powder is comminuted, blended with a softer metal-bearing powder, heated, crushed, cold-isostatically pressed, sintered, in the absence of an encapsulating member, and hot worked.

A number of references disclose processes for producing wrought products from metal powder. These references include U.S. Pat. Nos. 2,746,741; 3,052,976; 3,122,434; 3,270,409; 3,775,101; 3,810,757; 3,834,004; 3,975,193; 4,045,857; 4,069,044 and 4,110,131. None of these references disclose the process of the present invention.

Other references disclose processes wherein metal powder is subjected to some of those operations which make up the process of the present invention. These references include U.S. Pat. No. 4,343,650 which discloses the steps of comminution, blending softer metal powder, heating, and crushing and U.S. Pat. Nos. 2,329,698; 3,436,802 and 3,744,993 which disclose the step of heating. As with the previously referred-to references, none of these references disclose the process of the present invention.

It is, accordingly, an object of the present invention to provide a powder metallurgical process for producing a wrought product characterized by a low level of residual impurities.

The process of the present invention comprises the steps of: comminuting metal powder to effect a reduction in particle size, at least 60% of the comminuted particles being capable of passing through a −270 mesh Tyler screen; blending the metal powder with a softer metal-bearing powder; heating the blended powder particles at an elevated temperature, the particles adhering and forming a mass during heating; crushing the mass of powder particles; cold-isostatically pressing the crushed mass of powder; sintering the powder in the absence of an encapsulating member under conditions which effect a reduction in the nitrogen, oxygen and carbon levels of the powder; and hot working the sintered powder into a wrought product. The wrought product has less than 0.015% carbon. The metal powder, which is comminuted, is an alloy of two or more constituents. It is generally from the group consisting of cobalt-base, nickel-base and iron-base alloys.

Alloy powders are comminuted to effect a fine particle size. Compacts formed from fine particles are more susceptible to a reduction in their nitrogen, oxygen and carbon contents during sintering than are compacts formed from coarser particles. Comminution can be accomplished by any of those methods known to those skilled in the art. Ballmilling is presently preferred. The comminuted alloy will generally be such that at least 65% of the particles pass through a −270 mesh Tyler screen. A −270 mesh Tyler screen has openings of 0.0021 inch (53 microns).

The softer metal-bearing powder may vary from about 1% of the blended powders up to the maximum content of that metal in the wrought product. Nickel and copper have been successfully used as such.

The blended powder is heated to effect chemical homogenity in respect to segregation and to increase the compressibility of the powder. The temperature to which the powders are heated cannot be precisely set forth as it is dependent upon the type of powder being treated and the duration of the treatment. The temperature must, however, be sufficiently high to cause the particles to adhere and form a mass. A sufficient increase in chemical homogenity and compressibility is not attained if heating is not at a high enough temperature and/or for a long enough period of time for the particles to adhere. Too high a temperature, on the other hand, can harden the mass to the extent that it is difficult to crush (break up). Alloys within the scope of the present invention are generally heated to a temperature in excess of 1400° F. (760° C.). Heating is generally done in a vacuum or a reducing atmosphere, e.g., hydrogen. Crushing can be accomplished by any means known to those skilled in the art.

The crushed powder is cold-isostatically pressed, sintered in the absence of an encapsulating member under conditions which effect a reduction in the nitrogen, oxygen and carbon levels of the powder and hot-worked into a wrought product. The sintering temperature cannot be precisely set forth as it is dependent upon the type of powder being treated and the duration of the treatment. Alloys within the scope of the present invention are generally sintered at a temperature in excess of 1800° F. (982° C.). Sintering is generally done in a vacuum or a reducing atmosphere, e.g., hydrogen. The sintered product is generally characterized by a density of at least 85% of theoretical density, and preferably at least 90% of theoretical density, and by a carbon content of less than 0.015%, a nitrogen content of less than 0.02% and an oxygen content of less than 0.2%. Carbon, nitrogen and oxygen are often less than 0.01%, 0.01% and 0.02%, respectively. The carbon content of the crushed powder is usually at least 0.05%. Illustrative forms of hot working are forging, extrusion, rolling and swaging. The hot-worked product will have a density which approaches 100% of theoretical density.

The following examples are illustrative of several aspects of the invention.

EXAMPLE I

Metal powder was ball milled for 25 hours in trichloroethane. The milled powder was such that 70% passed through a −270 mesh Tyler screen. Only 52% passed through a −270 mesh Tyler screen prior to milling. The chemistry of the powder, in weight percent, was as follows:

| | | | |
|---|---|---|---|
| Cr | 17.1 | N | 0.15 |
| Mo | 18.9 | O | 0.61 |
| W | 5.2 | C | 0.18 |
| Si | 0.2 | Co | 0.64 |
| S | 0.01 | Cu | 0.02 |
| P | 0.01 | Ti | 0.01 |
| Fe | 8.3 | V | 0.01 |
| Mn | 0.08 | Zr | 0.2 |
| B | 0.03 | Ni | Bal |

The nitrogen, oxygen and carbon contents of the ball-milled powder were as follows:

N—0.18%
O—1.47%
C—0.5%

The milled powder was blended with nickel powder (80% milled powder and 20% nickel powder) and subsequently annealed for two hours at 1900° F. (1038° C.) in hydrogen. Particles of powder adhered and formed a mass during annealing. The mass was crushed using a jaw crusher and a pulverizer. The nitrogen, oxygen and carbon contents of the annealed powder were as follows:

N—0.04%
O—0.7%
C—0.34%

The crushed powder was cold-isostatically pressed at a pressure of 35,000 psi and, subsequently, sintered, in the absence of an encapsulating member, in two stages. The first stage was at 2200° F. (1204° C.) for four hours in hydrogen. The second stage was at 2350° F. (1288° C.) for four hours in a vacuum. Pressed and sintered densities were 55% and 86%, respectively, of theoretical density. The nitrogen, oxygen and carbon contents of the sintered product were as follows:

N—0.005%
O—0.01%
C—0.005%

The substantial reduction in the nitrogen 0.04% to 0.005%), oxygen (0.7% to 0.01%) and carbon (0.34% to 0.005%) contents during sintering is attributable to the fine grain size of the powder and the absence of an encapsulating member.

EXAMPLE II

Metal powder was ball-milled for 85 hours in water. The milled powder was such that 65.4% passed through a −270 mesh Tyler screen. Only 18.9% passed through a −270 mesh Tyler screen prior to milling. The chemistry of the powder, in weight percent, was as follows:

| | | | |
|---|---|---|---|
| Mo | 39.7 | Mg | 0.011 |
| N | 0.007 | Mn | 0.55 |
| O | 0.32 | P | 0.004 |
| C | 0.005 | S | 0.002 |
| Al | 0.01 | Si | 0.03 |
| B | 0.002 | Ti | 0.01 |
| Cr | 0.09 | V | 0.02 |
| Co | 0.02 | W | 0.02 |
| Cu | 0.01 | Zr | 0.02 |
| Fe | 0.06 | Ni | Bal |

The nitrogen, oxygen and carbon contents of the ball-milled powder were as follows:

N—0.02%
O—4.9%
C—0.03%

The milled powder was blended with nickel powder (70% milled powder and 30% nickel powder) and subsequently annealed for two hours at 1600° F. (871° C.) in hydrogen. Particles of powder adhered and formed a mass during annealing. The mass was crushed using a jaw crusher and a pulverizer. The nitrogen, oxygen and carbon contents of the annealed powder were as follows:

N—0.006%
O—0.16%
C—0.06%

The crushed powder was cold-isostatically pressed at a pressure of 35,000 psi and subsequently sintered, in the absence of an encapsulating member, for 24 hours at 2200° F. (1204° C.) in a hydrogen atmosphere. Pressed and sintered densities were 52% and 93%, respectively, of theoretical density. The nitrogen, oxygen and carbon contents of the sintered product were as follows:

N—0.001%
O—0.01%
C—0.005%

The sintered product was 2½ inches in diameter.

The substantial reduction in the nitrogen (0.006% to 0.001%), oxygen (0.16% to 0.01%) and carbon (0.06% to 0.005%) contents is attributable to the fine grain size of the powder and the absence of an encapsulating member.

The sintered product was extruded to a diameter of one inch at 2200° F. (1204° C.) and hot rolled from one inch to 9/16 inch at 2200° F. (1204° C.). No problems were encountered in extruding and hot rolling the product.

EXAMPLE III

Metal powder was ball milled for two hours in trichloroethane. The milled powder was such that 93% passed through a −270 mesh Tyler screen. Seventy and six-tenths percent passed through a −270 mesh Tyler screen prior to milling. The chemistry of the powder, in weight percent, was as follows:

| | | | |
|---|---|---|---|
| Si | 36.3 | Co | 0.9 |
| Al | 0.16 | Cu | 0.02 |
| C | 0.04 | Fe | 0.5 |
| O | 0.34 | Ni | Bal |

The oxygen and carbon contents of the ball-milled powder were as follows:

O—1.25%
C—0.5%

The milled powder was blended with nickel powder and copper powder (24% milled powder, 73% nickel powder and 3% copper powder) and subsequently annealed for two hours at 1500° F. (816° C.) in hydrogen. Particles of powder adhered and formed a mass during annealing. The mass was crushed using a jaw crusher and a pulverizer. The oxygen content of the annealed powder was 0.26%.

The crushed powder was cold-isostatically pressed at a pressure of 30,000 psi and subsequently sintered, in the absence of an encapsulating member, for two hours at 2000° F. (1093° C.) in a vacuum. Pressed and sintered densities were 55% and 95%, respectively, of theoretical density. The nitrogen, oxygen and carbon contents of the sintered product were as follows:

N—0.005%
O—0.19%
C—0.006%

The sintered product was 2½ inches in diameter.

The sintered product was extruded to a diameter of one inch at 1950° F. (1066° C.). No problems were encountered in extruding it.

It will be apparent to those skilled in the art that the novel principles of the invention disclosed herein, in connection with specific examples thereof, will suggest various other modifications and applications of the same. It is, accordingly, desired that, in construing the breadth of the appended claims, they shall not be limited to the specific examples of the invention described herein.

We claim:

1. In a process for producing a wrought product having less than 0.015% carbon, which process includes the steps of: compacting metal powder; sintering metal powder; and hot working said sintered powder; the improvement comprising the steps of: comminuting metal powder to effect a reduction in particle size, at least 60% of the comminuted particles being capable of passing through a −270 mesh Tyler screen, said metal powder being an alloy of two or more constituents; blending said powder with a softer metal-bearing powder; heating said blended powder particles at an elevated temperature, said particles adhering and forming a mass during heating; crushing said mass of powder particles; cold-isostatically pressing said crushed mass of powder; sintering said powder in the absence of an encapsulating member under conditions which effect a reduction in the nitrogen, oxygen and carbon levels of the powder; and hot working said sintered powder into a wrought product.

2. The process according to claim 1, wherein at least 65% of the comminuted particles are capable of passing through a −270 mesh Tyler screen.

3. The process according to claim 1, wherein said alloy is from the group consisting of cobalt-base, nickel-base and iron-base alloys.

4. The process according to claim 3, wherein said alloy is a nickel-base alloy.

5. The process according to claim 1, wherein said wrought product has less than 0.01% carbon.

6. The process according to claim 1, wherein said blended particles of powder are heated at a temperature of at least 1400° F. (760° C.).

7. The process according to claim 4, wherein said softer metal-bearing powder is nickel.

8. The process according to claim 1, wherein said crushed mass of powder has at least 0.05% carbon.

9. The process according to claim 1, wherein said step of comminuting comprises the step of ball milling.

10. The process according to claim 1, wherein said wrought product has less than 0.02% nitrogen and less than 0.2% oxygen.

11. The process according to claim 1, wherein said wrought product has less than 0.01% nitrogen and less than 0.02% oxygen.

12. A wrought powder metallurgical product of a cobalt-base, nickel-base or iron-base alloy having, in weight percent, less than 0.015% carbon, less than 0.02% nitrogen and less than 0.2% oxygen and made in accordance with the process of claim 1.

* * * * *